United States Patent [19]

Wolfe

[11] 4,324,999

[45] Apr. 13, 1982

[54] ELECTRON-BEAM CATHODE HAVING A UNIFORM EMISSION PATTERN

[75] Inventor: John E. Wolfe, Julian, Calif.

[73] Assignee: Burroughs Corporation, Detroit, Mich.

[21] Appl. No.: 145,043

[22] Filed: Apr. 30, 1980

[51] Int. Cl.[3] ..... H01J 1/16; H01J 19/10

[52] U.S. Cl. ..... 313/336; 29/25.17; 313/346 R; 427/77; 252/520

[58] Field of Search ..... 313/336, 346; 29/25.17; 427/78, 77; 252/520

[56] References Cited

U.S. PATENT DOCUMENTS 3,817,592 6/1974 Swanson ..... 313/336

3,947,716 3/1976 Fraser, Jr. et al. ..... 313/336

*Primary Examiner*—Saxfield Chatmon, Jr.

*Attorney, Agent, or Firm*—Charles J. Fassbender; J. Ronald Richbourg; Kevin R. Peterson

[57] ABSTRACT

Disclosed is an electron-beam cathode which emits electrons in a cone-shaped pattern whose electron density is substantially uniform throughout the cone. The cathode is comprised of a needle-shaped piece of single crystal tungsten having dopant atoms of zirconium and oxygen in the bulk thereof, and having only a single (100) surface on the needle's tip. This cathode is formed by the steps providing a needle-shaped piece of single crystal tungsten having dopant atoms of zirconium and oxygen in the bulk thereof, and having a plurality of ring-shaped (100) surfaces on the needle's tip; and subsequently transforming those surfaces into diagonally oriented planar surfaces by heating the needle in an atmosphere of oxygen to diffuse tungsten atoms from the needle's tip to its sides.

9 Claims, 7 Drawing Figures

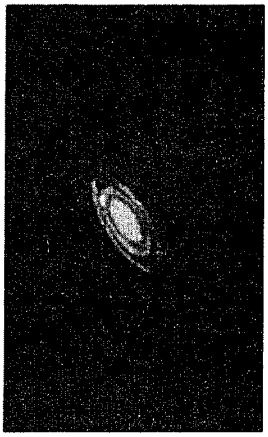
Fig. 5
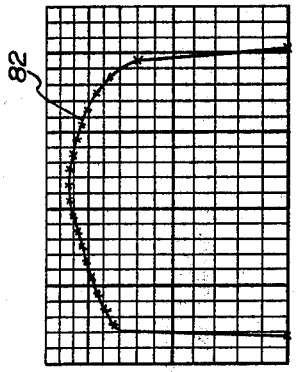
Fig. 6
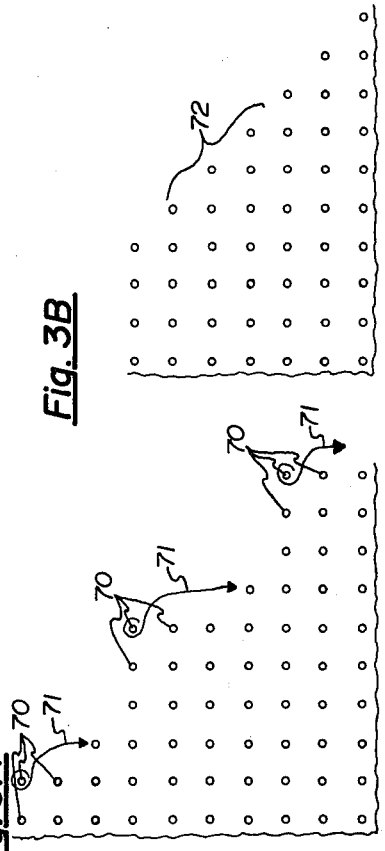
Fig. 3A
Fig. 3B
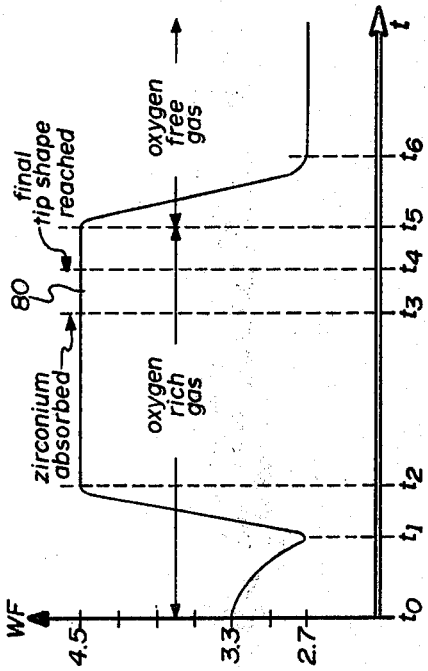
Fig. 4

ELECTRON-BEAM CATHODE HAVING A UNIFORM EMISSION PATTERN

BACKGROUND OF THE INVENTION

This invention relates to the subject of electronic emission from the surface of a metal; and more particularly to, methods for making low work function electron-beam cathodes which emit electrons in a cone-shaped pattern with a substantially uniform electron density throughout the cone.

In the prior art, one low work function electron-beam cathode has been described in U.S. Pat. No. 3,814,975 issued June 4, 1974 to Wolfe et al. Basically, that cathode consists of a single crystal tungsten needle, having a ring of zirconium and a hairpin-shaped filament attached to it.

During operation, the cathode is heated via the filament, which causes the zirconium to migrate from the ring over the surface of the tungsten needle to its tip. There, the zirconium atoms together with oxygen atoms in the residual gas of a vacuum that surrounds the needle cause the needle's work function to be reduced from 4.5 ev (for pure tungsten) to 2.7 ev.

One undesirable characteristic, however, of that cathode is that its work function is highly dependent on the needle's temperature and the pressure of the surrounding residual gas. In particular, for any given specific temperature, there is only one optimum operating pressure at which the beam current along the needle's axis is a maximum.

Still another undesirable characteristic of that cathode is that the density of electrons which are emitted from its tip is non-uniform. That is, for any given operating temperature and pressure, the electron density alternatively varies from a relatively high value, to a relatively low value, then to another high value, then to another low value, etc. as the angle of emission increases from the needle's axis. These variations in electron density can be "seen" experimently, by bombarding a phosphorous target with electrons from the cathode, and observing the visible light pattern which results. That pattern is in the form of a plurality of concentric rings.

Another cathode, which is a substantial improvement over the above '975 cathode, is described in co-pending United States patent application entitled "Low Work Function Cathode" by Wolfe et al filed Apr. 30, 1980 and assigned Ser. No. 145,042. Basically, this cathode is formed by a novel process which makes zirconium soluble in solid tungsten and produces a single crystal cathode having host atoms of tungsten and dopant atoms of zirconium and oxygen. The cathode which is produced by this method has a work function of 2.7 ev regardless of the operating temperature and pressure of the surrounding gas, so long as that gas is essentially oxygen free.

A problem which remains however, is that these cathodes also emit electrons with a non-uniform density as a function of angle from the needle's axis. The present invention address that problem and its solution.

Accordingly, a primary object of this invention is to provide an improved electron-beam cathode.

Another object is to provide a low work function electron-beam cathode which emits electrons in a cone-shaped pattern whose electron density is substantially uniform throughout the cone.

Still another object is to provide a method of making an electron-beam cathode which meets the above objectives.

BRIEF SUMMARY OF THE INVENTION

These and other objectives are accomplished in accordance with the invention by an electron-beam cathode which emits electrons in a cone-shaped pattern whose electron density is substantially uniform throughout the cone. The cathode is comprised of a needle-shaped piece of single crystal tungsten having dopant atoms of zirconium and oxygen in the bulk thereof, and having only a single (100) surface on the needle's tip which is surrounded on its perimeter by a plurality of diagonally sloped planar surfaces.

This cathode is formed by the steps providing a needle-shaped piece of single crystal tungsten having dopant atoms of zirconium and oxygen in the bulk thereof, and having a plurality of ring-shaped (100) surfaces on the needle's tip; and subsequently transforming all but one of those surfaces into diagonally oriented planar surfaces by heating the needle in an atmosphere of oxygen to diffuse tungsten atoms from the needle's tip to its sides.

In operation, the zirconium diffuses from the tungsten's bulk to its surfaces. But the spacing between the tungsten atoms on the (100) surface is different than the spacing between the tungsten atoms on the diagonally oriented surface. And as a result, the zirconium forms a monolayer only on the (100) surface, which gives that surface a much lower work function than the diagonally oriented surfaces.

BRIEF DESCRIPTION OF THE DRAWINGS

Various features and advantages of the invention will best be understood by reference to the following detailed description and accompanying drawings wherein:

FIGS. 3A and 3B illustrate the atomic lattice of various portions of the cathode in FIG. 2.

FIG. 4 illustrates a process for shaping the cathode's tip via the sequence of FIG. 2.

FIG. 5 is a microphotograph illustrating the electron emission pattern from a cathode which is processed up to time instant $t_3$ in FIG. 4.

FIG. 6 is a plot illustrating the electron emission pattern of a cathode which is processed up to time instant $t_5$ in FIG. 4.

DETAILED DESCRIPTION

Figure 1:
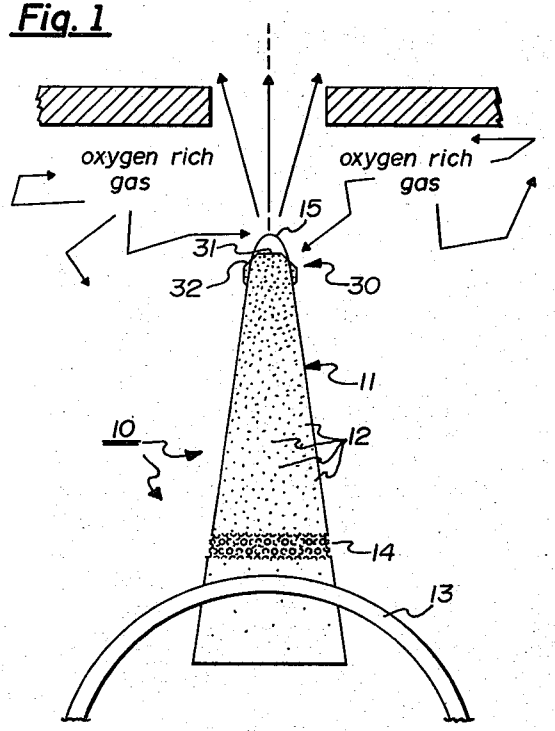
FIG. 1 illustrates the macroscopic structure of an electron-beam cathode which is constructed in accordance with the present invention.

Referring now to FIG. 1, an electron-beam cathode 10 which is constructed according to the invention will be described. Cathode 10 is comprised of a needle-shaped piece of single crystal tungsten 11 having dopant atoms 12 of zirconium and oxygen in the bulk thereof. A filament 13 is also included in the cathode as a means for heating the needle.

Suitably, the dopant atoms 12 are introduced into the needle by the method described in the aforementioned co-pending application entitled "Low Work Function Cathode" by Wolfe et al. In that method, a zirconium ring is formed around a single crystal needle-shaped piece of essentially pure tungsten; and then the zirconium is transferred from the ring to the tungsten's interior by bulk diffusion. A mottled ring-shaped pattern 14 remains on the tungsten's surface after this bulk diffusion is complete.

At the point in time where the zirconium ring has just finished completely diffusing into the tungsten's bulk, the tip of the single crystal needle will be somewhat rounded on a macroscopic scale as indicated schematically in FIG. 1 by reference numeral 15. On an atomic scale, the macroscopic rounded shape is actually comprised of a plurality of concentric (100) ring-shaped surfaces, as will now be described in greater detail in conjunction with FIG. 2.

Figure 2:
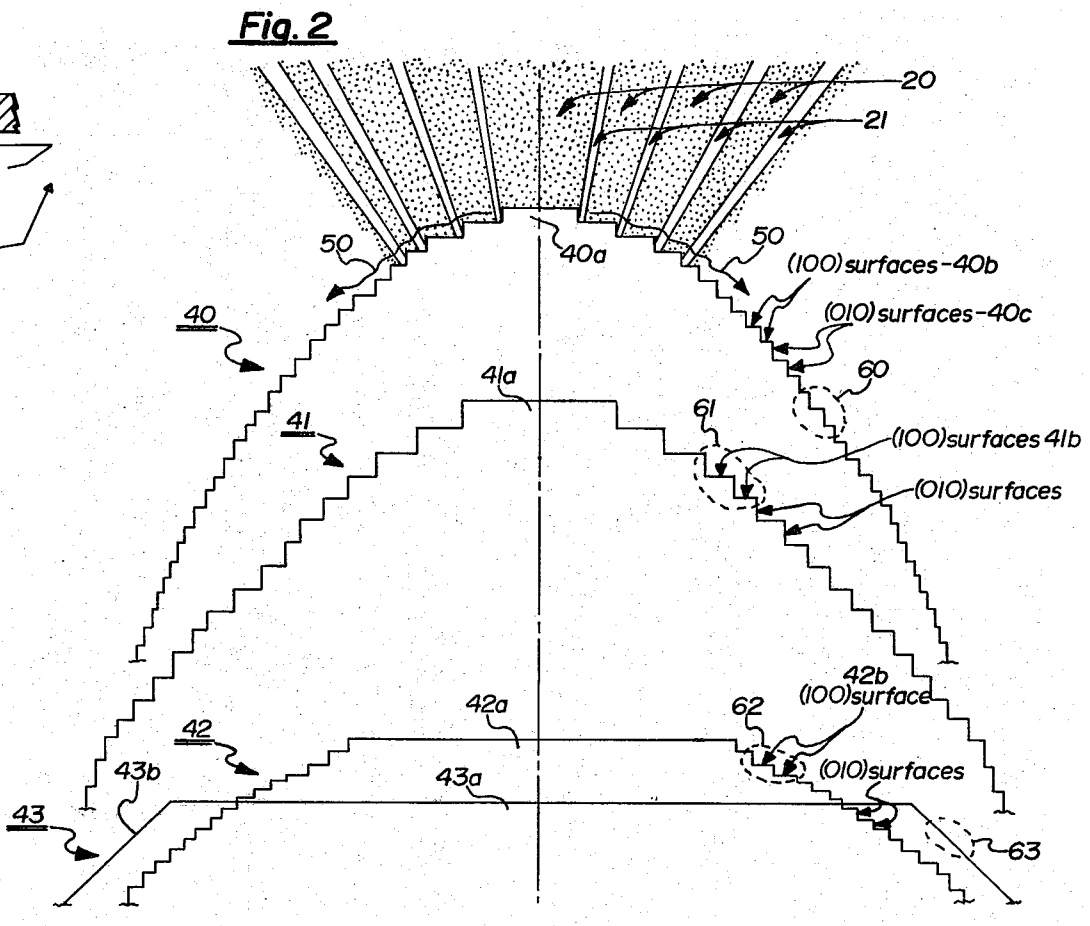
FIG. 2 illustrates the microscopic crystalline structure of the tip of the cathode in FIG. 1, and illustrates the sequence by which it is formed.

This rounded shape is undesirable because during operation, the electric field that is created by a potential difference between the cathode and anode, tends to be substantially higher at the outside intersection of the (100) and (010) surfaces, than at the inside intersection of those surfaces. Consequently, the density with which electrons are emitted from the cathode is non-uniform. In FIG. 2, reference numeral 20 indicates some of the ring-shaped regions of high electron emission, whereas reference numeral 21 indicates some of the ring-shaped regions of low electron emission. These rings become more pronounced as the height of the (010) surfaces increase, because more crowding of the electric field at the outside corners occurs as the (010) surface height increases.

In the present invention, the non-uniform emission pattern 20, 21 is eliminated by the process of placing the multi (100) surfaced single crystal needle in an atmosphere of oxygen rich gas, and subsequently heating it to diffuse tungsten atoms along the crystalline surfaces until only a single (100) surface exists on the crystal's tip. The resulting tip shape is indicated on a macroscopic scale in FIG. 1 by reference numeral 30. It consists of a single (100) surface 31 which is boardered around its perimeter by diagonally oriented planar surfaces 32, such as (110) surfaces, for example.

FIG. 2 schematically illustrates the sequence by which the multiple ring-shaped (100) surfaces of tip 15 are eliminated by the above process. Initially, when the zirconium just begins to diffuse from the ring into the bulk of the single crystal tungsten, the cathode's tip is shaped as indicated by reference numeral 40. This shape is the result of an etching process that is used to form the pure tungsten needle. For example, surface **40*a* may be 0.05 um–0.15 um across; the ring-shaped surfaces 40*b* may be 10 Å–200 Å wide; and the multiple (010) surfaces 40*c*** may also be 10 Å–200 Å high.

After the zirconium has been diffusing from the ring into the tungsten's bulk for several hours (e.g. 4 or 5 hours) the cathode's tip acquires a new shape as indicated by reference numeral 41. Basically, this new tip shape 41 arises because the tungsten atoms which form the (100) surfaces and (010) surfaces nearest to surface **40*a* diffuse on the outside of the needle towards its base as indicated by reference numeral 50. Consequently, the ring-shaped (100) surfaces and (010) surfaces "move". And this movement forms a new uppermost (100) surface 41*a* from a relatively wide portion of the needle's tip. Also, the bottom portion 41*b*** of the needle's tip is where many of the tungsten atoms stop diffusing and thus it grows in size.

At the point in time where all of the zirconium has diffused into the tungsten's bulk, the cathode's tip has a shape as indicated by reference numeral 42. It is characterized as having one relatively large (100) surface **42*a* which is surrounded by a plurality of relatively narrow (100) ring-shaped surfaces 42*b*. Surface 42*a* may be 0.45 um–0.55 um across for example, whereas surfaces 42*b*** are still only about 10 Å–200 Å across.

In the present invention, all of the ring-shaped (100) surfaces **42*b* are eliminated by heating cathode 42 in an oxygen rich gas until surface diffusion of the tungsten atoms produces a totally different tip shape 43. It is characterized as having only a single (100) surface 43*a*, which is very large (e.g.—about 1.0 um across), and which is boardered around its perimeter by a plurality of diagonally sloped planar surfaces 43*b***. By diagonally sloped is meant that the surfaces have at least two non-zero directional vectors, such as (110), (101), (121), etc.

To achieve this new shape 43 is significant because, during the cathode's operation, all of the diagonally sloped planar surfaces **43*b* exhibit a high work function. This is because the spacing between tungsten atoms on the diagonally sloped planar surfaces is different than the spacing between tungsten atoms on the (100) surface 43*a*; and the zirconium, which diffuses from the tungsten's bulk, forms a monolayer only on the (100) surfaces due to this difference in spacing. Thus, essentially all electron emission comes from the single (100) surface 43*a***; and it emits electrons in a relatively uniform fashion across its surface. Also, this shape is very stable in that once it is reached, the ring-shaped (100) surfaces and their corresponding ring-shaped emission pattern have never been found to reappear.

Further details of how the ring-shaped (100) surfaces are transformed into the above described diagonal oriented planar surfaces are illustrated on an atomic scale in FIGS. 3A and 3B. In particular, FIG. 3A shows the crystalline structure of the ring-shaped surface regions 60, 61, and 62 of FIG. 2; and FIG. 3B shows the crystalline structure of the diagonally oriented planar surface region 63 of FIG. 2. The transformation from one shape to the other is due to surface diffusion of the plurality of tungsten atoms 70. Their diffusion along paths 71 operates to "smooth out" the "steps" in the crystalline surface of FIG. 3A; and eventually this smoothing operation produces a new stable diagonally oriented planar surface 72 as indicated in FIG. 3B.

FIG. 4 contains a curve 80 illustrating the time sequence by which the diagonally oriented planar surfaces 72 are formed. At time $t_0$, the single crystal tungsten needle having a zirconium ring attached to it is initially heated in an oxygen rich gas. From that time until time $t_3$, the zirconium diffuses from the ring into the tungsten's bulk. That is, time $t_3$ is when the zirconium ring has dissipated and the cathode has a macroscopically round tip 15 as described above.

Thereafter, during the time interval $t_3$–$t_4$, the rounded tip 15 is reshaped by heating it in an oxygen rich gas. In general, the richer this gas is in oxygen, the shorter time interval $t_3$–$t_4$ will be, up to the point where all zirconium has been removed from the tip's surface. This is because the oxygen operates to greatly enhance the rate at which surface diffusion of the tungsten occurs. Preferably, the oxygen pressure should be at least fifty times the pressure of any other residual gas in the surrounding atmosphere.

The exact point in time at which the final tip shape is reached can only be determined by operating the cathode in an oxygen free gas and measuring current density across the needle's tip. This measuring can be done to a first approximation by utilizing the cathode to bombard a phosphorescent target, and observing if any ring-shaped visible light pattern is produced. An actual photograph of one such pattern 81 is given in FIG. 5. If that pattern exists, then further oxygen processing is required.

Preferably, the cathodes are processed in oxygen for several hours longer than the minimal time needed to reshape their tip, such as from $t_3$–$t_5$. This eliminates the need to repeatedly check them in the above manner. Following this extended oxygen treatment, the cathodes's electron emission pattern can be rigidly checked experimently by measuring it with a Faraday cup. Curve 82 in FIG. 6 is a plot of one such measurement. Such a check insures that no ring-shaped emission pattern exists which is too faint to detect with a phosphorescent target.

As one specific example of the above tip reshaping process, consider a tungsten needle as in FIG. 1, which is 30 mils high, 5 mils wide at its base; and has a ring of zirconium attached to it which is 5 mils wide, 1 mil thick, and 4 mils in diameter. This zirconium ring can be completely absorbed in the tungsten by heating them for about one day at 1800° K. in $10^{-6}$ Torr of oxygen and $10^{-8}$ Torr of residual gas. At that point in time however, the needle will have a ring-shaped emission pattern as illustrated in FIG. 5. That ring-shaped pattern can be transformed to the uniform pattern of FIG. 6 by heating the tungsten-zirconium needle for 10 more hours at 1800° K. in $10^{-6}$ Torr of oxygen and $10^{-8}$ Torr of residual gas. Thereafter, the cathode can be operated indefinitely (i.e.—for thousands of hours) in an oxygen free gas to achieve both a low work function and a ring-free emission pattern.

One preferred embodiment and steps for carrying out the invention have now been described in detail. In addition, however, various changes and modifications can be made to these details without departing from the nature and spirit of the invention. Therefore, it is to be understood that the invention is not limited to said details but is defined by the appended claims.

What is claimed is:

1. A method of making an electron-beam cathode which emits electrons in a cone-shaped pattern whose electron density is substantially uniform throughout the cone; said method including the steps of:

providing a needle-shaped piece of single crystal tungsten having dopant atoms of zirconium and oxygen in the bulk thereof, and having a plurality of concentric ring-shaped (100) surfaces on the needle's tip; and heating said needle in an atmosphere of oxygen to diffuse atoms from said ring-shaped surfaces toward the needle's base until said ring-shaped surfaces are eliminated and only a single (100) planar surface exists on said needle's tip.

2. A method according to claim 1 wherein said heating occurs for approximately ten hours at a temperature of 1700° K.–1900° K.

3. A method according to claim 1 wherein said atmosphere of oxygen has a partial pressure of at least fifty times the partial pressure of any other gases contained herein.

4. A method according to claim 1 wherein said zirconium is at least 10% by volume of said tungsten.

5. A method according to claim 1 wherein said single (100) surface is at least 0.5 um in area.

6. An electron-beam cathode which emits electrons in a cone-shaped pattern whose electron density is substantially uniform throughout the cone; said cathode being formed by the steps of:

providing a needle-shaped piece of single crystal tungsten having dopant atoms of zirconium and oxygen in the bulk thereof, and having a plurality of concentric ring-shaped (100) surfaces on the needle's tip; and heating said needle in an atmosphere of oxygen to diffuse atoms from said ring-shaped surfaces toward the needle's base until said ring-shaped surfaces are eliminated and only a single (100) planar surface exists on said needle's tip.

7. An electron-beam cathode which emits electrons in a cone-shaped pattern whose electron density is substantially uniform throughout the cone; said cathode being comprised of a needle-shaped piece of single crystal tungsten having dopant atoms of zirconium and oxygen in the bulk thereof, and having only a single (100) planar surface on the needle's tip; said single (100) surface being formed by heating said needle in an atmosphere of oxygen to diffuse atoms from the needle's tip to its base.

8. A cathode according to claim 7 wherein said zirconium is at least 10% by volume of said tungsten.

9. A cathode according to claim 7 wherein said single (100) surface is at least 0.5 um in area.

* * * * *